United States Patent [19]

Steinmetz et al.

[11] Patent Number: 4,884,766

[45] Date of Patent: Dec. 5, 1989

[54] AUTOMATIC FIN DEPLOYMENT MECHANISM

[75] Inventors: Harold F. Steinmetz, Ferguson; Gerald H. Wisdom, Florissant, both of Mo.

[73] Assignee: The United States of America as represented by the Secretary of the Air Force, Washington, D.C.

[21] Appl. No.: 198,279

[22] Filed: May 25, 1988

[51] Int. Cl.[4] ..... F42B 15/027; F42B 15/053

[52] U.S. Cl. ..... 244/3.27; 244/3.29

[58] Field of Search ..... 244/3.27, 3.28, 3.29, 244/3.3, 49

[56] References Cited

U.S. PATENT DOCUMENTS

| | | | |
|---|---|---|---|
| 2,977,880 | 4/1961 | Kershner | 244/3.29 |
| 3,063,375 | 11/1962 | Hawley et al. | 244/3.28 |
| 3,563,495 | 2/1971 | Korn | 244/3.29 |
| 3,695,556 | 10/1972 | Gauzza et al. | 244/3.29 |
| 3,711,040 | 1/1973 | Carver | 244/3.21 |
| 4,323,208 | 4/1982 | Ball | 244/3.28 |
| 4,575,025 | 4/1986 | Sadvary et al. | 244/3.27 |
| 4,709,877 | 12/1987 | Goulding | 244/3.28 |
| 4,778,127 | 10/1988 | Duchesneau | 244/3.29 |

*Primary Examiner*—Deborah L. Kyle
*Assistant Examiner*—Michael J. Carone
*Attorney, Agent, or Firm*—Jules J. Morris; Donald J. Singer

[57] ABSTRACT

The invention comprises a fin fold mechanism for extending a moveable fin from an air flight vehicle wherein the fin deployment mechanism is fixably housed within the vehicle. A pyrotechnic gas generation actuation means is positioned within the fin extension mechanism in order to actuate a drive mechanism comprising a drive piston that pivots the fin into its extended position. Clutch means is connected to the piston for transferring movement from the piston to the moveable fin. A retraction mechanism is also provided for disconnecting the clutch means from the fin after the fin is fully extended; this allows controlled axial rotation of the fin.

20 Claims, 4 Drawing Sheets

AUTOMATIC FIN DEPLOYMENT MECHANISM

TECHNICAL FIELD

This invention relates to fin deployment mechanisms for air flight vehicles and is particularly related to low drag fin fold mechanisms for air launched rockets or missiles.

BACKGROUND OF THE INVENTION

A variety of air launched rockets and missiles have been either produced or proposed for a variety of military and space oriented missions. Such air vehicles are typically stored beneath the wing of an aircraft prior to launch. In order to allow secure storage of the rocket or missile below the aircraft wing without adversely affecting aircraft aerodynamics, the air vehicle control fins must be folded away from the airstream.

Conventional fin fold mechanisms, which may also be referred to as automatic fin deployment mechanisms, have used springs and hydraulic actuators adjacent to the fin to deploy it immediately after rocket or missile launch. Controlled rotation of the deployed fin(s) is generally required for control of the missile or rocket. Deployment mechanisms for such fins tend to be rather large and to produce flight hindering aerodynamic drag. While such mechanisms may be appropriate for relatively low speed air vehicles, they create flight problems for high speed supersonic vehicles such as are now being designed and produced. A further problem with military vehicles of this type is that large fin fold mechanisms increase the radar cross section of the fin and thus increase the likelihood of undesired detection.

An example of the prior art can be found in U.S. Pat. No. 3,563,495 to Korn. In the Korn patent, pneumatic or hydraulic means mounted to a slideable cylinder is positioned in the fin adjacent to a hinge. Sliding actuation of a shaft which is keyed to the hinge causes a raising and lowering of the fin. While the Korn device is an improvement over the prior art, the hinge and its base increase the fin cross section unacceptably. Further, because of its raised hinge, the Korn device forms an aerodynamically objectionable extension from the rocket body even when the fin is retracted.

Another example of prior art can be found in U.S. Pat. No. 2,977,880 to Kershner. The fin erector of Kershner comprises an external spring mechanism mounted on the exterior of the air vehicle. The Kershner device has a great deal of external hardware adjacent to the fin and thus produces a substantial increase in aircraft and missile drag during flight. Further, it is not clear whether the fin of Kershner could be actively controlled (rotated) in a manner suitable for modern missile or rocket control. Another spring loaded fin erection mechanism is shown in U.S. Pat. No. 3,695,556 to Gauzza et al.

In view of the above, a need clearly exists for improved automatic fin deployment mechanisms that produce less aerodynamic drag on high speed air vehicles and have less effect on the cross section of extended fins.

A need also exists for automatically deployed fin fold mechanisms that allow full controlled rotational movement of the extended fins after extension.

SUMMARY OF THE INVENTION

The invention comprises a fin fold mechanism for extending a moveable fin from an air flight vehicle, wherein the fin deployment mechanism is fixably housed within the air flight vehicle. A pyrotechnic gas generation actuation means is positioned within the fin extension mechanism in order to actuate a drive mechanism comprising a drive piston that pivots the fin in its extended position.

In the preferred embodiment of the invention, clutch means is connected to the piston for transferring movement from the piston to the moveable fin. It is also preferred that a retraction mechanism be provided for disconnecting the clutch means from the fin after the moveable fin is fully extended, this allows controlled axial rotation of the fin.

A further aspect of the preferred embodiment of the invention is the provision for first and second locking means for locking the moveable fin in stored and extended positions. Specifically, the gas generator is interconnected with the first locking means so that ignition of the gas generator releases the extendable fin from the locked stored position. When the fin is fully extended, the second locking means is spring loaded to lock the moveable fin in an upright position while still allowing controlled rotation of the fin along the fin's vertical axis.

In the preferred embodiment of the invention, the piston is provided with internal and external splines in order to translate linear motion into rotational motion. As the piston is driven by the actuation means it is forced to rotate by interlocking spiral grooves on the housing mechanism. A torque shaft having straight grooves interlocking with the piston is provided to carry the rotational movement of the piston to the clutch means which uses the rotational movement to pivotably extend the fin.

Other aspects of the preferred embodiment includes damping means for braking piston motion.

An object of the invention, therefore, is to provide an automatically deployable fin fold mechanism for the extension of a moveable fin on an air flight vehicle, that is fully enclosed within the air vehicle housing. An advantage of this invention is its low aerodynamic drag stemming from minimization of fin cross section. A further advantage of this invention is its decreased radar cross section which also results from the removal of the fin fold mechanism from the exposed fin.

Yet another object of this invention is to provide a fin fold mechanism that disengages after fin deployment. An advantage of this invention is that the extended fin is fully controllable and can be rotated for precise rocket or missile control.

Yet another object of this invention is to provide a fin fold mechanism of minimum size in order to permit its placement within the missile or rocket housing without displacement of an extensive amount of rocket material.

The foregoing and other objects and advantages of the invention will be apparent from the following more particular description of the preferred embodiments of the invention, as illustrated in the accompanying drawings, in which like reference characters refer to the same parts throughout the different views. The drawings are not necessarily to scale, emphasis instead being placed upon illustrating the principles of the invention.

DETAILED DESCRIPTION OF THE INVENTION

Figure 1:
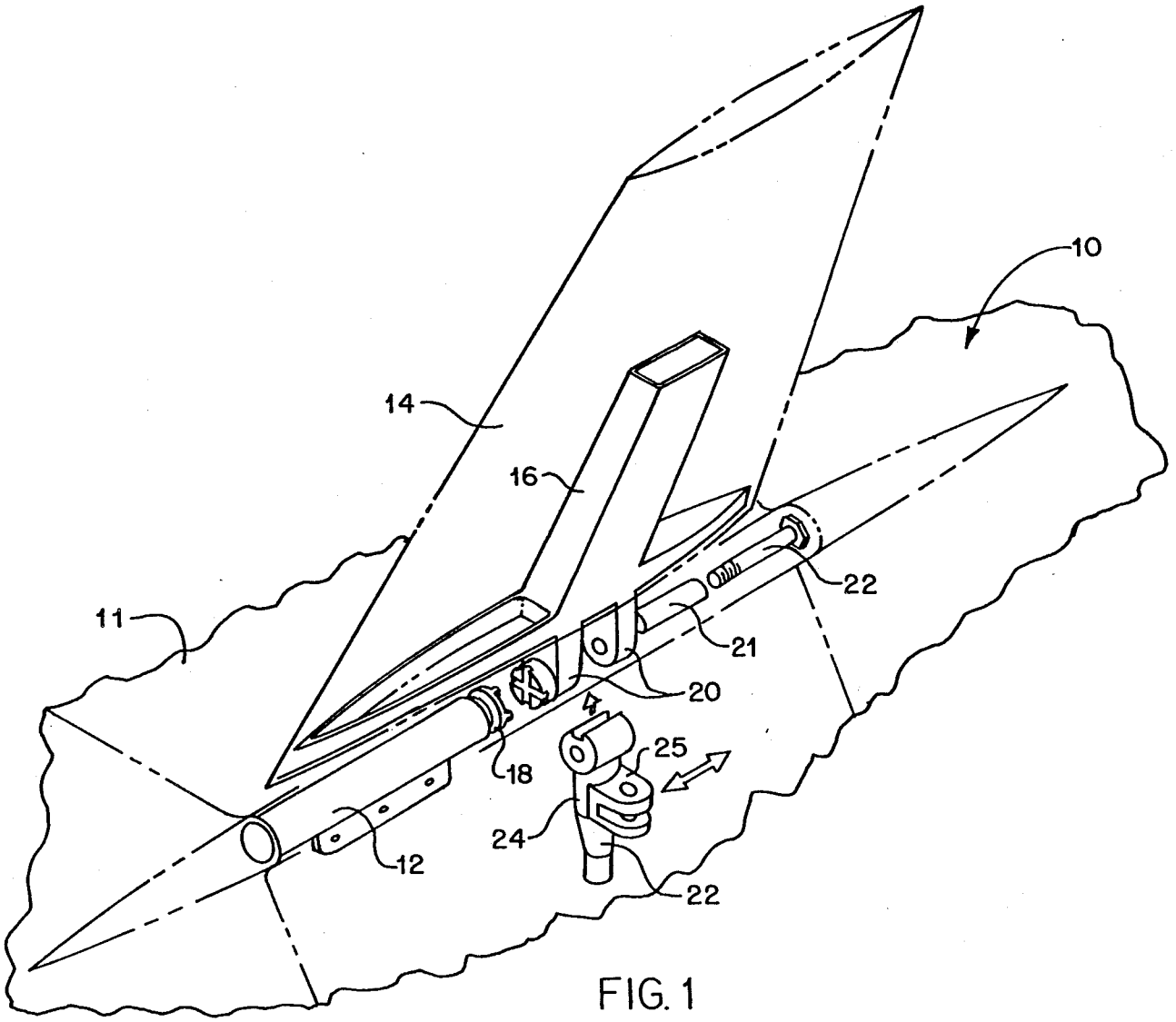
FIG. 1 is a schematic representation of an automatic fin fold deployment mechanism incorporating the principles of this invention.

FIG. 1 is a schematic representation of the invention as installed in an air vehicle 10 which can comprise a manned or unmanned aircraft, rocket or missile. For this reason only a portion of the air vehicle 10 is shown in the schematic. The invention comprises an automatic fin deployment mechanism 12 that is installed inside the air vehicle body at the base of a fin 14. The automatic deployment mechanism typically locks the fin in stored position adjacent to the air vehicle body 11 until the vehicle is air launched, at which time the mechanism 12 automatically extends the fin 14 by pivoting support spar 16 upward. The mechanism acts through a retractable clutch 18 that engages a hinge section 20 having a hinge pin 21 attached by bolt 22.

It is intended that this mechanism be particularly suitable for extending control fins for use during flight. Such control fins are typically controlled on an axis perpendicular to the air vehicle by an actuator mechanism 22 that also engages the hinge section of the fin 20. The actuator mechanism typically is attached to actuation means through a clevis 25 so as to produce a desired axial rotation of the fin.

Figure 2C:
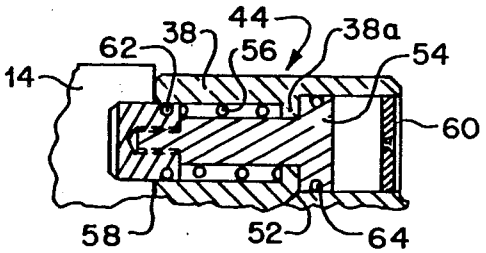
FIG. 2*c* is a cross-sectional view of a fin lock mechanism which is hidden from view behind the cross section of FIG. 2.
Figure 2:
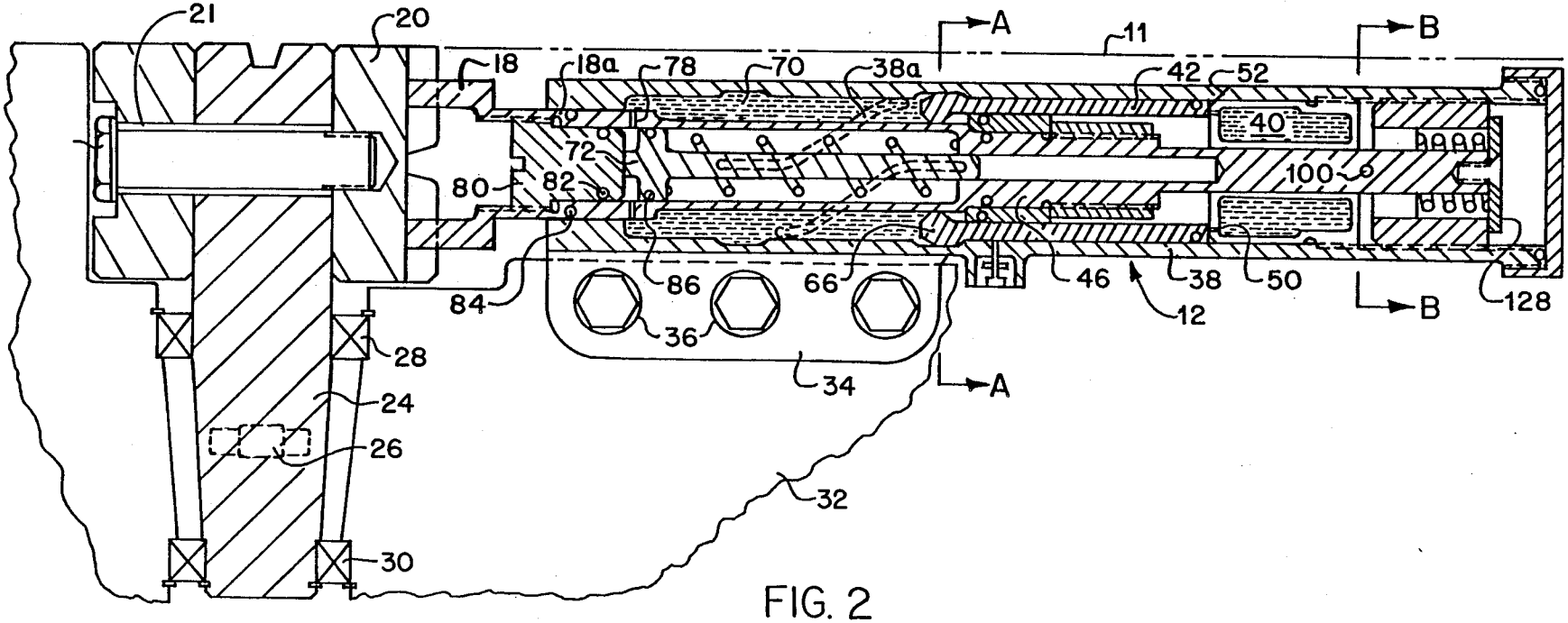
FIG. 2 is a cross-sectional view of the fin fold mechanism of FIG. 1.
Figures 3, 3D:
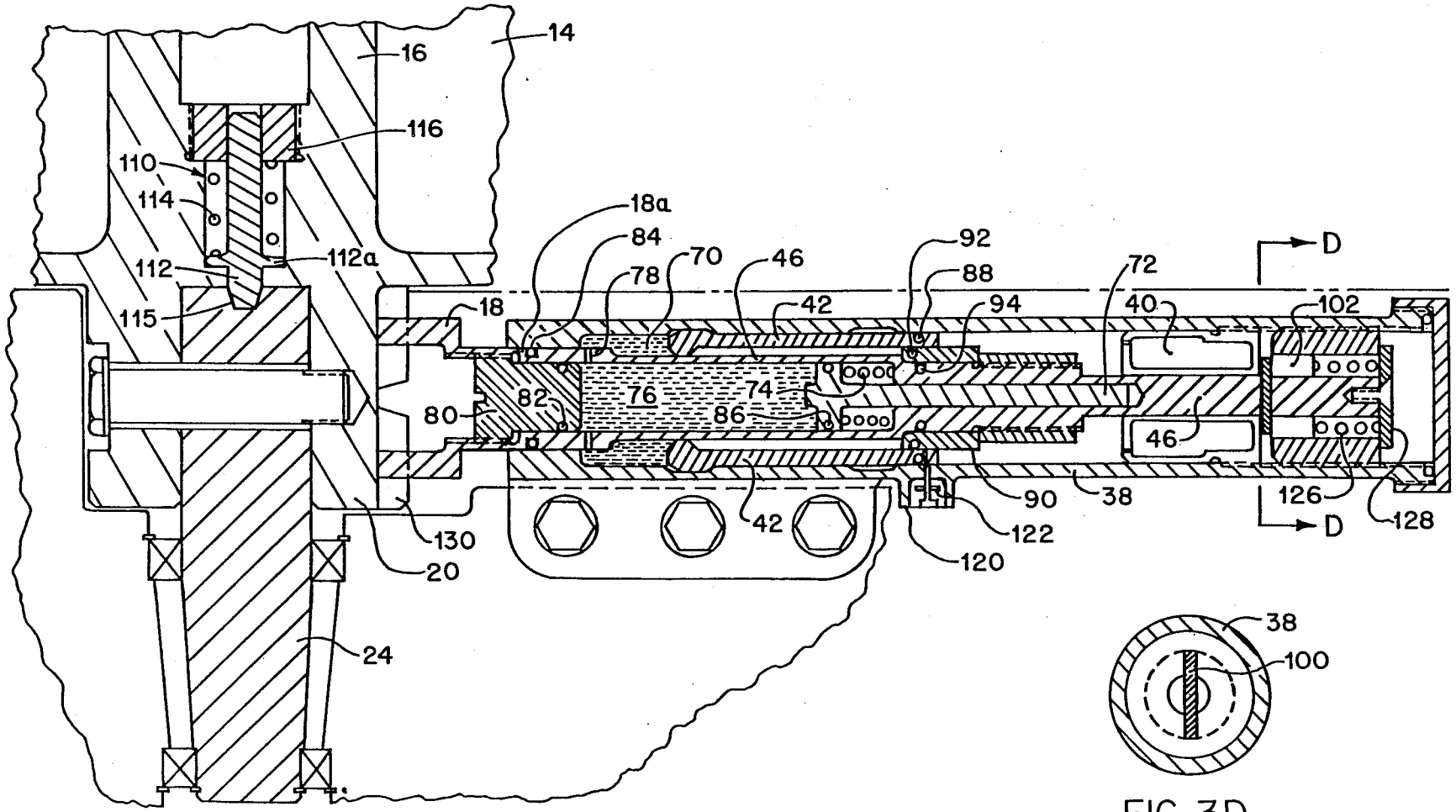
FIG. 3 is a cross section of the fin fold mechanism of FIG. 2 as it appears after actuation.
FIG. 3D is a cross section taken along line DD of FIG. 3.
Figure 4:
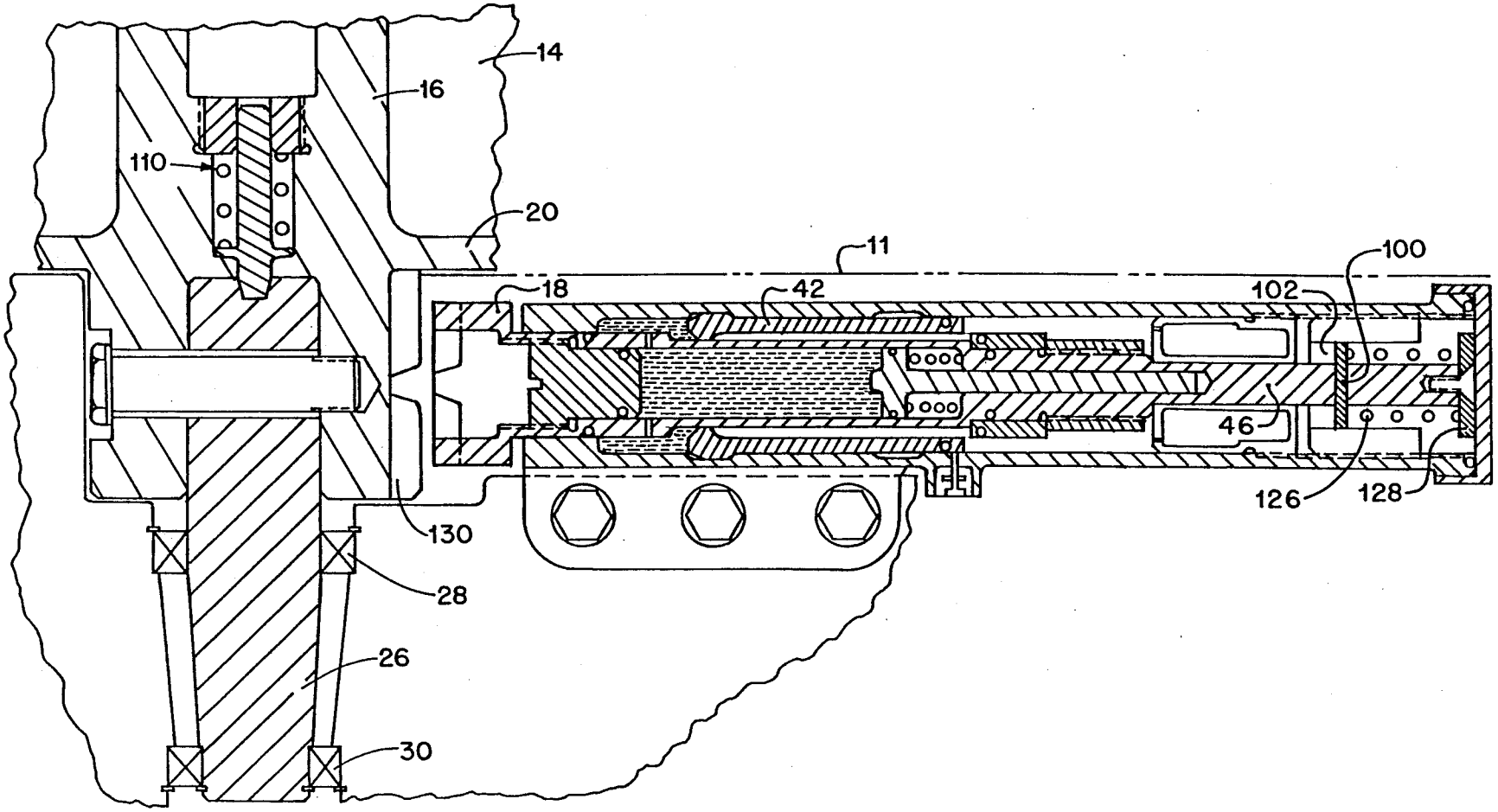
FIG. 4 is a cross-sectional view of the fin fold mechanism of FIG. 2 showing the mechanism as it appears after the fin is fully extended.

The invention can be more fully understood with reference to the detailed cross-sectional drawings discussed below. FIG. 2 is a view of the fin fold deployment mechanism prior to use, FIG. 3 is a similar cross section during operation of the mechanism and FIG. 4 is a view of the same mechanism after the fin has been fully extended and locked into position.

Returning now to FIG. 2, the automatic fin fold deployment mechanism 12 is attached through clutch 18 to the fin hinge 20. The fin hinge is attached by means of bolt 22 to actuator control shaft 24. The shaft 24 is attached at clevis 25, by means of a uniball or other rotary type joint 26, to a control actuator (not shown). Bearings 28 and 30 surround and support the shaft in order to permit smooth shaft rotation after extension.

The deployment mechanism 12 is fixedly attached to an internal strut 32 of the missile body (partially broken away) by attachment flange 34. Three bolts 36 are used to attach the mechanism to the missile. The attachment flange 34 is fixedly attached to the fin fold deployment mechanism housing 38.

The major components of the fin fold deployment mechanism 12 are all located in housing 38 within the missile body 11. In order to drive the mechanism, a pyrotechnic gas generator 40 is fluidly connected to a hollow drive piston 42 and a fin lock mechanism 44 (shown in cross section in FIG. 2*c*). The piston 42 slidingly engages a torque shaft 46 and spiral grooves **38*a* on the inner surface of the housing 38. The torque shaft 46 is rigidly connected to clutch 18**.

The operation of these elements can be more readily understood by reviewing their interaction in detail with reference made to FIGS. 2 through 4. The pyrotechnic gas generator 40 is of conventional design and may be ignited either electrically or by chemical means. Heated gas from the generator 40 is transferred by multiple orifices 50 to the base of piston 42. Orifice 52, which is shown in both FIG. 2 and FIG. 2*c*, transfers some of the heated expanding gas to the folded fin lock mechanism 44. This lock mechanism is positioned behind the cross section of FIG. 2 and thus would be obscured if not broken out in FIG. 2*c*.

The locking mechanism 44 is formed as part of the housing 38 of the fin fold deployment mechanism. It comprises a piston 54 which is spring loaded by spring 56 into engagenent with a portion of the fin 14. The spring 56 engages both a flange **38*a* of the housing and a cap portion 58 of the piston 54. Gas is spread through orifice 52 to push the piston towards base 60. As the piston 54 moves torwards base 60, cap portion 58 is withdrawn from fin 14 allowing for fin movement. Seals 62 and 64 are provided to prevent gas leakage around the piston 54**.

As gas pressure builds up in the pyrotechnic gas generator, gas flowing through multiple orifices 50 drives the main drive piston 42 to the left as shown in FIGS. 2 and 3. Briefly looking ahead at FIG. 3, piston 42 is shown at the end of its travel. Piston 42 has a spline portion 66 which has both internal and external splines. This can be more readily understood with reference to the cross section AA shown in FIG. 2*a*. In this view, piston 42 (at spline portion 66) forms the intermediate ring between the housing 38 and torque tube 46. Splines **66*a* on the piston engages grooves formed on the outer housing 38. The housing grooves 38*a* are also shown in FIG. 2 and can be seen to be shaped in a spiral which forces the piston to rotate as it moves to the left. The inner splines 66*b* of the piston 66 engage grooves 46*a* of the torque tube which are formed as straight slots. The spiral and straight slots, in combination, result in rotary and linear movement of the piston but only rotary movement of the torque shaft 46. In other words, the torque shaft merely rotates as the piston slides along the straight splines while being forced to rotate by grooves 38*a***.

Piston damping is provided by a fluid filled cavity 70. As the piston 42 is driven to the left (towards the fin hinge 20), fluid from cavity 70 drives plunger 72 back towards the right. This can be graphically seen with reference to FIG. 3, in which plunger 72 is fully retracted against spring 74 and fluid from the fluid cavity 70 fills central area 76. The fluid is transferred from cavity 70 into 76 through orifices 78 which comprises a series of holes through torque shaft 46.

Returning now to FIG. 2, it can be seen that the torque shaft 46 is fixedly attached to clutch 18 at flange **18*a*. Rotary movement of the torque shaft is therefore transmitted to the clutch 18 which pivots the fin hinge 20**.

A plug 80 is provided to seal the fluid damping chamber 76 (FIG. 3). Seals 82 on the plug and seals 84 between the torque shaft and the housing 38 are provided to prevent loss of fluid from the chamber. Plunger 72 is equipped with a seal 86 to prevent fluid leaks from the chamber 76 into the area of springs 74.

Seals are also provided to prevent unintended loss of gas expelled from the pyrotechnic gas generator. Piston 42 is provided with seal 88 (FIG. 3) which seals against housing 38. Annulus 90 is fitted with seal 92 which seals against the piston while torque shaft 46 has a seal 94 which seals against annulus 90. The pyrotechnic gas generator is thus sealed from leakage into the fluid chamber and clutch mechanism. The pyrotechnic gas generator 40 is also fixedly sealed and attached to the housing 38 to prevent backflow of gas towards the base of the mechanism (the right most part of the figure).

FIGS. 3 and 4 show the fin 14 after it has been fully extended. Several things happen after the extension of fin to permit actuation of the fin through control shaft 24.

When the fin is fully extended, lock mechanism 110 is activated to lock the fin in the fully extended position. Lock mechanism 110 comprises of a plunger 112 that is biased to the extended position by a spring 114. Spring 114 extends from flange 112*a* on the plunger to spring seat 116 which is fixedly attached to the fin spar 16. When the fin is fully extended the plunger is aligned with a depression 115 on the control shaft 24 and the plunger 112 springs forward into the depression locking the fin in the extended position.

As shown in FIG. 3, piston 42 is fully extended (towards the left side of the figure) and the fluid from the fluid damper has been driven into chamber 76. As a result of the splines and grooves described above, the torque shaft 46 has been fully rotated with the clutch 18 and the fin has been fully extended. After the piston completes its full stroke it passes over a gas exhaust port 120. This allows gas from the pyrotechnic gas generator 40 to burst diaphragm 122 and be exhausted to atmosphere, thus reducing the pressure in the area behind the piston and the torque shaft.

Figure 2B:
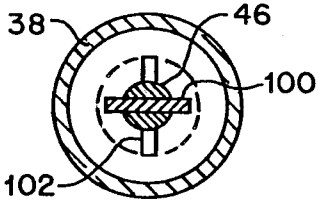
FIG. 2*b* is a cross section taken along line BB of FIG. 2.
Figure 2A:
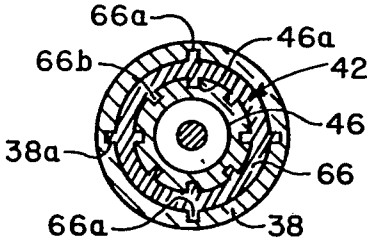
FIG. 2*a* is a cross section taken along line AA of FIG. 2.

Full rotation of the torque shaft 42 aligns pin 100 with slot 102 (FIGS. 2*b* and 3*d*). As shown in FIG. 4, movement of the pin 100 in slot 102 allows previously compressed spring 126 to push back against back plate 128 of the torque shaft 46. This withdraws the torque shaft and the attached clutch 18 from contact with its fin hinge mating surface 130, thus releasing the fin so it may be rotated by the control shaft 24.

Thus the automatic fin fold deployment mechanism described above is designed for rapid deployment of the fin and quick disengagement to permit controlled use of the fin. The internal fluid damping system for the piston is particularly useful in preventing damage to the fin during its rapid extension. Undamped fins can sometimes be bent or damaged by being too quickly extended. A further improvement over prior art design can be seen in the operation of clutch 18 which can effectively apply the rotational force needed to extend the fin and yet be quickly withdrawn after the fin is fully extended. The improvements of this invention, in combination, permit the placement of the fin fold deployment mechanism entirely within the outer skin of a missile or other type air vehicle. This, in turn, improves missile body aerodynamics to reduce aerodynamic drag and radar cross section return. Extraneous structures on the skin of the air vehicle, missile or fin, as shown widely in prior art, have been completely replaced.

While the invention has been shown and described with reference to the preferred embodiment thereof it will be understood by those skilled in the art that various changes and substance and form can be made therein without departing from the spirit and scope of the invention as described in the appended claims.

We claim:

1. A fin fold mechanism for extending a moveable fin from an air flight vehicle housing comprising:

a mechanism housing fixidly positioned within said air flight vehicle;

an actuation means positioned within said mechanism housing;

a drive means connected for actuation to said actuation means and also positioned within said mechanism housing;

clutch means connected to said drive means for transferring rotary movement from said drive means to the moveable fin; and a retraction mechanism for disconnecting said clutch means from the fin after the moveable fin is fully extended.

2. The fin fold mechanism of claim 1 wherein the actuation means comprises a pyrotechnic gas generator.

3. The fin fold mechanism of claim 2 further comprising a first locking means for locking the moveable fin in a stored position; and a second locking means for locking the moveable fin in an extended position.

4. The fin fold mechanism of claim 3 wherein said gas generator is interconnected with said first locking means so that gas from said gas generator releases said first locking means when said gas generator is activated.

5. The fin fold mechanism of claim 3 wherein said second locking means is spring loaded to lock said moveable fin in an upright position while still allowing controlled fin rotation.

6. The fin fold mechanism of claim 1 wherein said drive means further comprises a piston, with internal and external splines, seated within said mechanism housing, said piston engaging said actuation means and said clutch means in order to deliver force from said actuation means to said clutch means.

7. The fin fold mechanism of claim 6 wherein a torque shaft is interposed between said piston and said clutch means.

8. The fin fold mechanism of claim 7 wherein said outer piston splines interlock with spiral inner grooves in said mechanism housing and said inner piston splines interlock with straight grooves on said torque shaft in order to cause rotation said torque shaft and said clutch which results in the extension of said fin.

9. The fin fold mechanism of claim 7 further comprising damping means for braking piston motion in order to prevent damage to said fin during its extension.

10. The fin fold mechansim of claim 7 wherein said retraction mechanism is actuated by full rotation of said piston.

11. A fin fold mechanism for extending a moveable fin from a flight vehicle housing comprising:

a first locking means for locking the moveable fin in a stored position;

actuation means for activating the fin fold mechanism and releasing said first locking means;

a second locking means for locking the moveable fin in an extended position;

retraction means for disengaging said fin fold mechanism from said moveable fin in order to permit axial rotation of said fin.

12. The fin fold mechanism of claim 11 wherein the fin fold mechanism is positioned within the flight vehicle housing.

13. The fin fold mechanism of claim 11 wherein the actuation means comprises a pyrotechnic gas generator.

14. The fin fold mechanism of claim 13 wherein said gas generator is interconnected with said first locking means so that gas from said gas generator acts to release said first locking means when said gas generator is activated.

15. The fin fold mechanism of claim 11 wherein said second locking means is spring loaded to operate when said fin reaches its fully extended position.

16. The fin fold mechanism of claim 11 wherein said fin fold mechanism further comprises a piston with internal and external splines seated within a housing, said piston engaging said actuation means and said clutch means in order to deliver force from said actuation means to said clutch means.

17. The fin fold mechanism of claim 16 wherein a torque shaft is interposed between said piston and said clutch means.

18. The fin fold mechanism of claim 17 wherein said outer piston splines interlock with spiral inner grooves in said housing and said inner piston splines interlock with straight grooves on said torque shaft so that said piston rotates as it is driven forward by said actuation means which results in rotational movement of said torque shaft and said clutch that is transferred to said fin in order to extend said fin.

19. The fin fold mechanism of claim 16 further comprising damping means for braking piston motion in order to prevent damage to said fin during its extension.

20. The fin fold mechanism of claim 16 further comprising retraction means for disconnecting said clutch from said fin after said fin has been extended.

* * * * *